United States Patent [19]

Kohler et al.

[11] Patent Number: 4,827,937

[45] Date of Patent: May 9, 1989

[54] METHOD AND APPARATUS FOR CONTROLLING THE OPERATING CHARACTERISTIC QUANTITIES OF AN INTERNAL COMBUSTION ENGINE

[75] Inventors: Rolf Kohler; Peter J. Schmidt; Manfred Schmitt, all of Schwieberdingen, Fed. Rep. of Germany

[73] Assignee: Robert Bosch GmbH, Stuttgart, Fed. Rep. of Germany

[21] Appl. No.: 831,476

[22] Filed: Feb. 20, 1986

[30] Foreign Application Priority Data

Feb. 21, 1985 [DE] Fed. Rep. of Germany ..... 3505965

[51] Int. Cl.[4] ..... F02B 3/00

[52] U.S. Cl. ..... 123/486; 123/440; 123/417

[58] Field of Search ..... 123/425, 488, 440, 489, 123/417, 486

[56] References Cited

U.S. PATENT DOCUMENTS

| | | | |
|---|---|---|---|
| 4,351,281 | 9/1982 | Geiger | 123/425 |
| 4,365,299 | 12/1982 | Kondo | 123/480 |
| 4,530,333 | 7/1985 | Nishimura | 123/480 |
| 4,561,400 | 12/1985 | Hattori | 123/480 |
| 4,566,420 | 1/1986 | Sakamoto | 123/489 |
| 4,589,390 | 5/1986 | Wazaki | 123/489 |
| 4,646,697 | 3/1987 | Grob | 123/440 |

*Primary Examiner*—Ronald B. Cox

*Attorney, Agent, or Firm*—Walter Ottesen

[57] ABSTRACT

The invention relates to a method and apparatus for controlling operating characteristic quantities of an internal combustion engine. For issuing an uncorrected anticipatory control value, a characteristic field is addressed by directing pregiven operating characteristic quantities as addresses and, with a simultaneously superposed control, an averaged value of the control factor is applied to the anticipatory control region for effecting an adaptive learning procedure. From the averaged control factor, a global factor is defined which works multiplicatively on the entire basic characteristic field. This considers especially multiplicative disturbance influences. Also, by means of a dividing of the self-adaptive characteristic field into a non-changeable basic characteristic field and into at least one further changeable factor characteristic field corresponding thereto, each basic value is multiplied within a pregiven influence region by means of the associated factor of the factor characteristic field whereby mostly additive disturbing influences are considered. Global factor and the particular factor from the factor characteristic field can conjointly work upon the control value issued by the basic characteristic field.

19 Claims, 14 Drawing Sheets

$ti_{max}$ = 9.2 ms

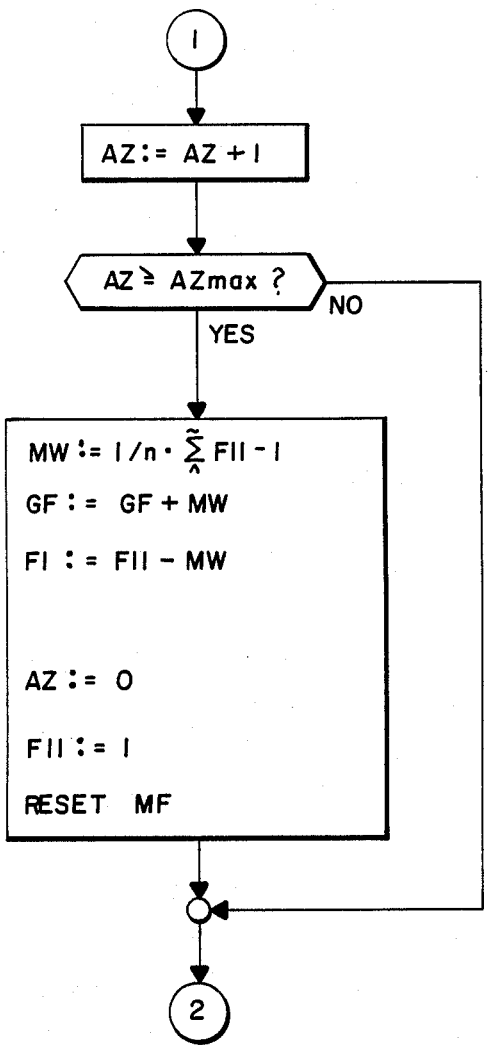

COUNTER TO DETERMINE PERIOD OF TIME DURING WHICH FACTOR CHARACTERISTIC FIELD II IS ADAPTED

ADAPTATION OF FACTOR CHARACTERISTIC FIELD II COMPLETED ?

AVERAGING OF ALL FACTORS OF FACTOR CHARACTERISTIC FIELD II

ADAPTATION OF GLOBAL FACTOR

TRANSFER OF MODIFIED FACTORS II INTO FACTOR CHARACTERISTIC FIELD I

RESET AZ COUNTER

RESET FACTOR CHARACTERISTIC FIELD II

RESET ALL MEMORY FLAGS

FIG. 14

METHOD AND APPARATUS FOR CONTROLLING THE OPERATING CHARACTERISTIC QUANTITIES OF AN INTERNAL COMBUSTION ENGINE

FIELD OF THE INVENTION

The invention relates to a method and an apparatus for controlling the operating characteristic quantities of an internal combustion engine.

BACKGROUND OF THE INVENTION

U.S. Pat. No. 4,676,215 refers to the possibility to modify values stored in a matrix memory or characteristic field and accessed in dependence on operating characteristic quantities of the internal combustion engine in accordance with a learning process, such that not only one single predetermined characteristic value is modified but also the characteristic values lying in its vicinity, with these additional modifications occurring in dependence on the modification of the characteristic value concerned. Specifically, this can be accomplished such that during the actual operation of the internal combustion engine an integral controller continuously acts in a multiplicative manner on the value read out from the characteristic field while at the same time the multiplicative correction factor of the controller is averaged. On departure from the environment of a specific support point in the matrix memory or characteristic field which is subdivided into a predetermined number of support points and wherein intermediate values are computed by linear interpolation defining the environment of each support point, the mean value is incorporated into the corresponding support point. In this manner, the characteristic field is adapted to the values predetermined by the controller by modification of the support points, so that the entire range of the anticipatory control learns adaptively. On the other hand, it is thereby avoided that only specific ranges of the characteristic field are included in the learning process which would be the case if single values were adapted. Therefore, the subject of the above-mentioned U.S. Pat. No. 4,676,215 eliminates the problem that in particular in characteristic fields with relatively fine subdivisions single values are accessed only very rarely or not at all, and consequently are not adapted. As a result, the entire characteristic field serving for the anticipatory control of corresponding operating characteristic quantities would become substantially distorted in the course of time.

In this connection, it is generally known from German published patent application DE-OS 2,847,021 and British patent application GB-PA 2,034,930B to configure mixture control systems such that the fuel is metered via so-called learning control systems. Such a learning control system stores in a characteristic field, for example, injection values for transfer to a read-write memory each time the engine is started. The characteristic fields provide for a very quick response of the precontrol of, for example, the injected fuel quantity or of fuel metering generally, or also of other quantities which are to be adapted to the changing operating conditions of an internal combustion engine as quickly as possible, including ignition point, exhaust-gas recirculation rate, and the like. In order to obtain learning control systems, the individual characteristic field values can be corrected in dependence on operating characteristic quantities and can be written into the appropriate memory.

The following explanations relate to further improvements in the control action of self-adaptive characteristic fields. At least partly and to avoid repetition, they are based on the disclosure of U.S. Pat. No. 4,676,215 the full contents of which are herewith also made the subject of the disclosure of the present application and are incorporated by reference herein.

Self-optimizing injection systems or other systems for the open and closed-loop control of operating characteristic quantities possess a characteristic field, here for the duration of injection, with rotational speed and, for example, throttle flap position as input quantities (addresses), the characteristic field being subdivided into the ranges idling, part load, full load and overrun, for example. At idling, the rotational speed is controlled, at part load the control objective is, for example, minimum fuel consumption, while it is maximum power in the full-load range. In the overrun mode of operation, the supply of fuel is cut off and, with the adaptation of the characteristic field to the individual values predetermined by the controller, a learning method for the fast control range (self-adaptive anticipatory control) is introduced. The controller referred to in the foregoing can evaluate any desirable suitable actual value quantity of the controlled system as input quantity. Its output quantity acts for the actual control area multiplicatively on the value read out from the characteristic field in dependence on the input addresses (for example, rotational speed, throttle flap position or load) and operates on the learning range of the anticipatory control (characteristic field) preferably via an averaged control factor. If the controlled system is an internal combustion engine as in this application, the engine variable evaluated as actual value may be the output signal of a Lambda sensor or some other appropriate sensor in the exhaust duct, or the engine variable may be the rotational speed of the internal combustion engine if, due to an extreme value control (wobbling) of specific controlled operating characteristic quantities (duration of injection ti, air quantity and the like), minimum fuel consumption or maximum power are the control objectives. A comprehensive description of such control methods is given in the above-mentioned U.S. Pat. No. 4,676,215.

SUMMARY OF THE INVENTION

It is, therefore, an object of the invention to improve the learning method in self-adaptive characteristic fields and to shorten the duration of adaptation substantially by the introduction of additional possibilities, in particular, to respond, on changes of characteristic field, as promptly as possible to such factors that influence extended areas of the characteristic field in the same manner.

This object is achieved with the method and apparatus of the invention which afford the advantage that it is particularly in the presence of multiplicative and/or additive disturbances which account for the majority of changes of the characteristic field that the entire characteristic field can be adapted through the introduction of a global factor substantially faster than through an adaptation of respective individual values or support points, even though this adaptation also covers their respective environment. Further, the invention also provides for a faster and correspondingly accurate adaptation of such characteristic field ranges which are accessed only rarely or very rarely.

In another advantageous embodiment of the invention, the subdivision into basic characteristic field and factor characteristic field performing the self-adaptation (adaptive learning) prevents the interpolation which conventionally is to be performed in the region of the basic characteristic field from adversely affecting the learning process. In this embodiment, the self-adaptive characteristic field (factor characteristic field) permits above all the consideration of additive influences and disturbances, whereas multiplicative influences, which usually account for a uniform portion of the disturbances, can be taken into consideration by a combination with the global factor referred to above, so that, overall, a fast and optimal adaptation considering additive and multiplicative influences can be accomplished.

Further advantages and improvements of the invention will become apparent from the subsequent description of embodiments in conjunction with the drawing and from the claims.

BRIEF DESCRIPTION OF THE DRAWING

The invention will now be described in more detail with reference to the drawing wherein:

FIGS. 13 to 15 are a series of flow charts wherein:

FIG. 13 is the flow chart showing the succession of steps in the learning method for the determination of the global factor according to FIG. 11, identified as method I;

FIG. 14 is the flow chart of method II including one sub-variant for the determination of the global factor, forming an addition to FIG. 13; and, FIG. 15 is the flow chart of method II including another sub-variant for the determination of the global factor.

DESCRIPTION OF THE PREFERRED EMBODIMENTS OF THE INVENTION

Figure 1:
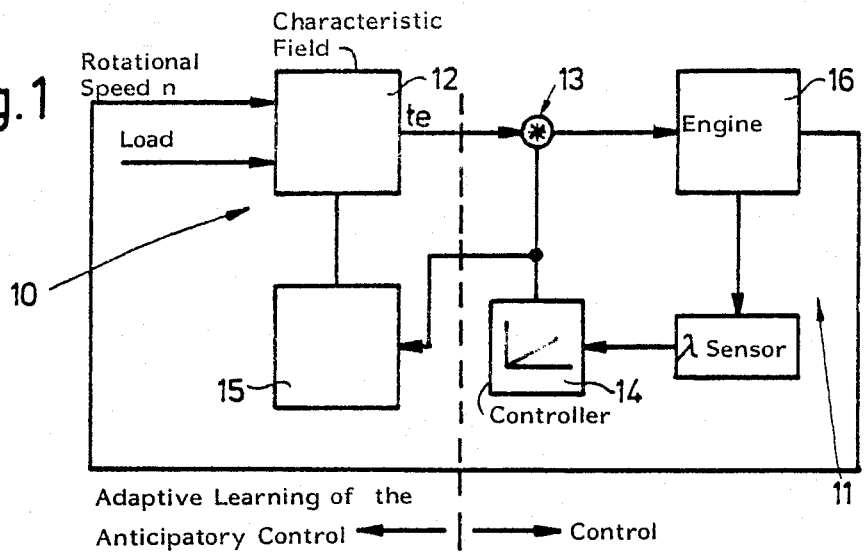
FIG. 1 is a schematic block diagram showing the basic principle of a combined open and closed-loop control method for the operation of an internal combustion engine wherein, derived from the actual control, the range of fast anticipatory control is acted upon to achieve a relatively slowly proceeding self-adaptation of the characteristic field provided by way of example in this anticipatory control (adaptive learning)

The different forms and variants of the invention supplement in two different essential aspects the basic idea explained in detail in the U.S. Pat. No. 4,676,215 referred to above and incorporated herein by reference. In simple terms, the one aspect is the subdivision of the self-adaptive characteristic field into a non-variable basic characteristic field and a variable factor characteristic field, wherein the basic value read out from the basic characteristic field and assigned to specific input addresses is multiplied by the factor obtained from the factor characteristic field and assigned to the same input addresses. The other aspect includes the possibility to define a global factor acting on the entire characteristic field in a preferably multiplicative and/or additive manner. For a comprehensive understanding of the invention, it is therefore necessary to know the subject of the above-mentioned U.S. Pat. No. 4,676,215. It is understood that all embodiments and findings disclosed in the U.S. Pat. No. 4,676,215 are equally disclosed and valid for this application.

Further it is noted that the means represented in the drawing and indicating the invention and its various aspects with reference to discrete components or blocks are not to be construed as limiting the invention but serve particularly to illustrate the basic functional effects of the invention and to indicate a possible form of implementation for specific functional sequences. Individual modules, components or blocks may incorporate analog, digital or also hybrid technology or may comprise, wholly or in part, parts of program-controlled digital systems or programs, that is, they may be implemented in the form of, for example, microprocessors, microcomputers, digital logic circuits, and the like. Accordingly, the following description of the invention is to be viewed merely as a preferred embodiment in respect of the overall function and time sequences, the effect accomplished by the blocks described, and the interaction of the subfunctions represented by the individual components, with the references to the switching blocks being made for a better understanding.

FIG. 1 shows a combined open and closed-loop control system for the operation of an internal combustion engine, which may be a spark-ignition engine (Otto engine) or an auto-ignition Diesel engine, each equipped with intermittent or continuous injection through a fuel injection system or the supply of fuel through any type of fuel-metering means (controlled carburetor). The following explanations refer particularly to fuel metering, more particularly to the generation of fuel injection pulses ti the durations of which are to be determined; however, the combined open-loop and closed-loop control method is also applicable to the generation and the measurement of other operating characteristic quantities of particularly an internal combustion engine, for example, in the control of the ignition point, the charge-air pressure, the determination of the exhaust-gas recirculation rate, or also the idle-speed control.

The block diagram of FIG. 1 can be subdivided into an anticipatory open-loop control range 10 for the rapid generation of an anticipatory control value te for fuel injection, and a closed-loop control range 11 superposed on the open-loop control and acting at point 13 multiplicatively on the characteristic values generated by the characteristic field in dependence on the input addresses which, in turn, depend on operating quantities. Considering, however, that the controller has to transiently settle in again in each operating point, the anticipatory control range 10 is configured in a complementary manner as already described in the U.S. Pat. No. 4,676,215 referred to above such that a block 15 is provided for adaptive learning from the controller output value. This block provides for self-adaptation of the characteristic field quantities for the individual operating points, so that the adaptation error of the basic characteristic field 12 becomes progressively smaller. The adaptation error of the basic characteristic field 12 is normally corrected by the controller 14 as soon as possible.

The U.S. Pat. No. 4,676,215 referred to above explains in detail how the adaptive corrections of the individual characteristic values are accomplished, subject to the condition to additionally modify, preferably in a weighted fashion, further characteristic values occurring in the vicinity of modified characteristic values. These additional modifications are made in dependence on the modification of the corresponding characteristic value. The result is a rapid and accurate adjustment of the characteristic field to the actual operating conditions of the internal combustion engine 16.

Figure 2:
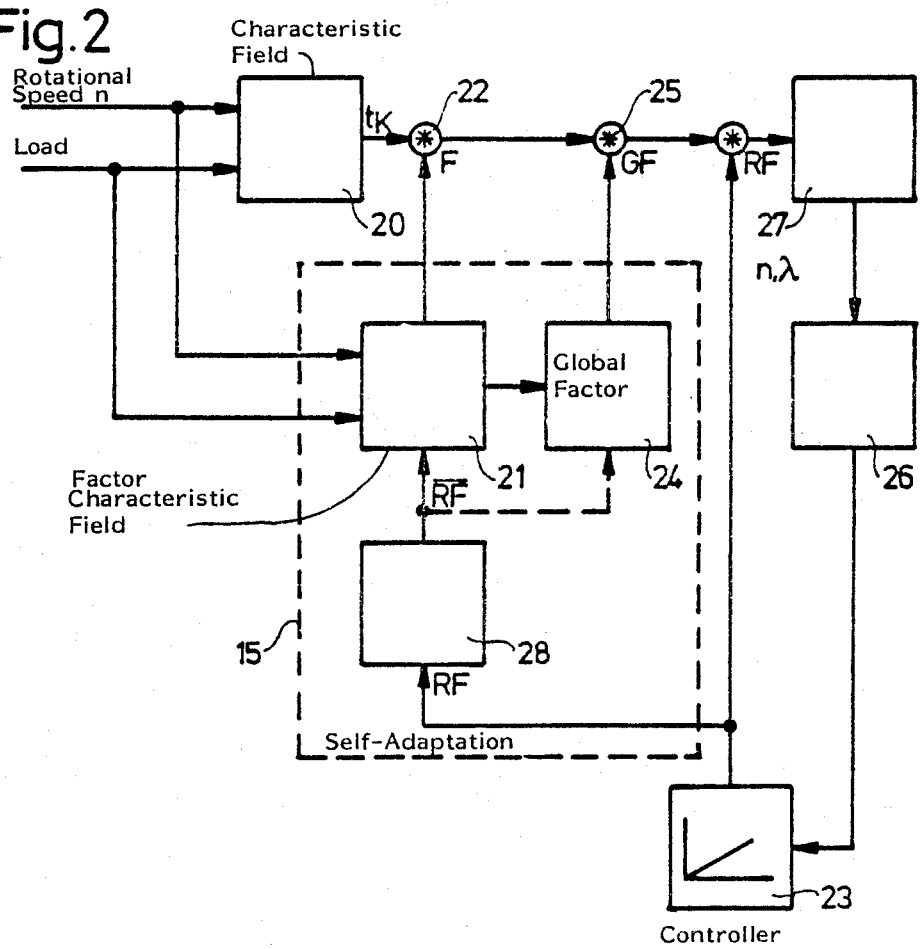
FIG. 2 is a block diagram of a first embodiment indicating a combination of preferred learning methods and including a representation of the possibilities to act upon the anticipatory control value of the operating characteristic quantity concerned from the self-adaptation range.

In order to ensure a rapid optimization of the self-adaptation of the characteristic field, considering both additive and multiplicative disturbances, FIG. 2 of the invention proposes substantially the two embodiments referred to above, reflecting different aspects of the invention. It is suggested to configure block 15 for the adaptive learning of the anticipatory control, that is, of the characteristic field, such that the following specialized learning method for the characteristic field results, as shown in FIG. 2 by way of example, in the electronic fuel injection system with superposed Lambda control, extreme value control, or the like:

1. The duration of injection is represented by basic characteristic field 20, preferably a read-only memory (ROM), which in the embodiment shown receives as input quantities the rotational speed n and a load quantity ($Q_L$ or throttle flap position $\alpha$) and, depending on the number of support points available in ROM and the number of interpolation steps, issues in the desired quantization an anticipatory control value ($t_K$) of the respective fuel quantities associated with these addresses.
2. The self-adaptation (adaptive learning) is accomplished by means of a separate factor characteristic field 21, preferably a random-access memory (RAM) to which the same addresses (here rotational speed and load) are applied in parallel as to the basic characteristic field 20. Preferably, basic characteristic field 20 is subdivided into specific ranges of a predetermined size, with each range being assigned a factor from the factor characteristic field. Within these ranges, the output quantity $t_K$ of the basic characteristic field is then multiplied by the factor F issued by the factor characteristic field at an operating point 22, preferably a multiplication point.
3. In this arrangement, the adaptation by the factor characteristic field is only performed in stationary operating points.
4. The second important aspect of the invention, also included in FIG. 2, consists in providing a global factor for the consideration of multiplicative disturbances, that is, disturbances which can influence the entire characteristic field uniformly. The global factor acts multiplicatively on the entire basic characteristic field (basic matrix memory) 20. In this arrangement, the formation of the global factor can be derived from either the averaged value of control factor RF issuing from controller 23 or the factor characteristic field (factor matrix memory) 21. The global factor is represented by block 24 and acts multiplicatively on the characteristic value $t_K'$ already corrected by factor F at operation point 25.

The embodiment of FIG. 2 is completed by the control loop formed by the controller 23 referred to in the foregoing. The controller 23 receives the output of a suitable measurement device 26 sensing an output quantity to be treated as the actual value of the controlled system: internal combustion engine (Lambda value, rotational speed, more precisely, speed variations in an extreme value control or the like). Thus, the final duration of injection time ti in accordance with FIG. 2 is obtained applying the following formula:

$$ti = t_K.F.GF.RF$$

The two aspects of factor characteristic field and global factor are each separately of inventive merit. Further, they can be used independently of one another and are shown in FIG. 2 in their interaction on the anticipatory control value merely for the purpose of a better understanding of the overall concept of the invention.

The global factor GF acts multiplicatively and/or additively on every one of the anticipatory control values issued by the characteristic field; factor F issued by factor characteristic field 21 acts only locally. This is also the reason why the same input addresses as for basic characteristic field 20 are applied in the parallel control. In addition to the internal combustion engine identified by reference numeral 27 in FIG. 2 and constituting the controlled system, a mean value generator 28 is provided receiving control factor RF from the output of controller 23; thus, the global factor can be derived from the corresponding averaged control factor $\overline{RF}$ or from the factor characteristic field.

Figure 3:
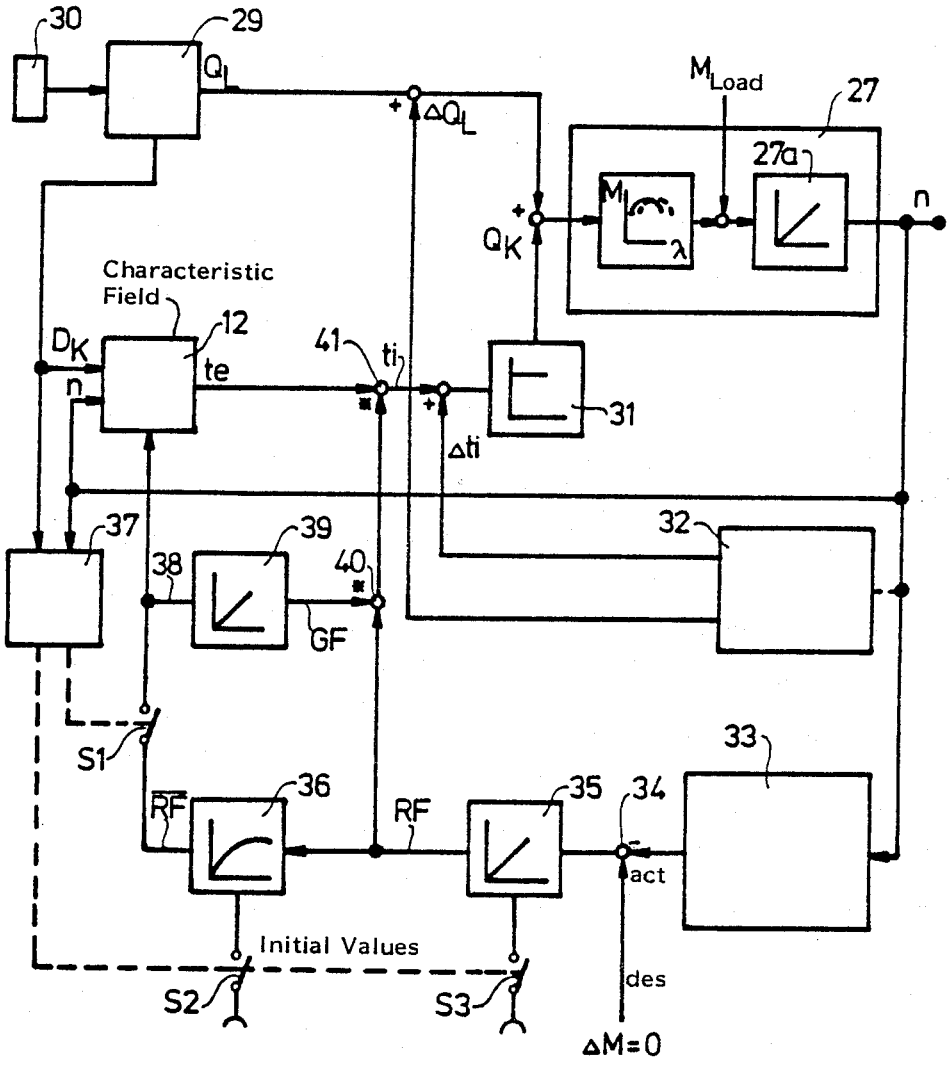
FIG. 3 is a block diagram of a more detailed embodiment for determining a global factor influencing the anticipatory control quantity issued by the characteristic field in a complementary manner, based upon an extreme value control as a possible control method.

Referring now to FIG. 3, the following will deal in more detail with a preferred embodiment of a self-adaptive characteristic field with correction by global factor GF, as well as with a first possible method for determining or calculating the value of the global factor. FIG. 3 shows in more detail the generation of a fuel injection anticipatory control value with superposed control for an internal combustion engine. This control, different from the embodiment of FIG. 2, is specifically configured as an extreme value control. It should be noted that the components or blocks shown in the drawing are assigned identical reference numbers if their structures and functions are identical; if the differences are only minor, prime will be added to the number. In FIG. 3, the fuel quantity to be metered to the internal combustion engine 27 as the controlled system is controlled by characteristic field 12 to which again the rotational speed n and the throttle flap position $D_K$ (may also be indicated as angle $\alpha$) are applied as input quantities (addresses). The throttle flap 29 is controlled by an accelerator 30. The duration of injection ti stored in the characteristic field is translated into a corresponding fuel quantit $Q_K$ via injection valves 31; this fuel quantity as well as the air quantity $Q_L$ determined by the throttle flap position are supplied to the internal combustion engine 27, producing a torque M in dependence on the Lambda value of the air-fuel mixture. The controlled system internal combustion engine 27 can be approximated by its integrator action illustrated by block 27*a*. The output quantity (rotational speed n) of the internal combustion engine is then again the input quantity into characteristic field 12, in addition to the throttle flap position.

This pure open-loop control method described so far is superposed by a closed-loop control which is based on the principle of an extreme value control (it has already been mentioned that also other actual output quantities of internal combustion engines can be used, such as exhaust-gas composition, erratic running conditions, or the like). In the embodiment of an extreme value control shown, either the air quantity $Q_L$ is wobbled (via a bypass, for example) at a predetermined stroke $\Delta Q_L$, or the duration of injection ti is wobbled with stroke $\Delta$ti. The test signals required for this purpose are provided by a test signal generator 32 which acts, depending on the type of extreme value control, either on the fuel quantity or on the air quantity with a wobble frequency which can be selected constant or dependent on the rotational speed. It will be obvious that these periodic variations of the air quantity $Q_L$ or the fuel quantity supplied to the internal combustion engine produce torque changes which can also be sensed as rotational speed changes by a measurement device 33. This measurement device 33 analyzes these rotational speed changes and relates them appropriately to the wobble frequencies and the wobble impact by evaluating amplitude and/or phases. The measurement device 33 is followed by an actual/desired value comparison point 34 the output of which is connected to a controller 35. Controller 35 generates a control factor RF which may directly be used for influencing the values issued by the characteristic field. The embodiment described, however, uses a different procedure which is explained below.

The output of controller 35 which is preferably configured as an integrator is connected to a block 36 for averaging the control factor, its output $\overline{RF}$ acting upon individual characteristic values or support point values of characteristic field 12 via a switch Sl. This operation may be accomplished particularly with the weighting diminishing in the environment of the characteristic value or support point value concerned.

A range detector 37 to which the input quantities or addresses of characteristic field 12 are applied in parallel serves to operate switches Sl, S2 and S3 by means of which mean-value generator 36 and controller 35 can be reset to their respective initial values. Range detector 37 determines in which range (including idle, part load, full load and overrun) or sphere of influence of a support point (half the distance between two support points) the driving curve is located. The driving curve is defined by the input data $D_K$ and n. The range detector 37 releases, in accordance with the result, the incorporation of the averaged correction value $\overline{RF}$ the support point of characteristic field 12 last accessed and, through a cross connection 38, into a block 39 for generation of the global factor. At the same time, controller 35 and mean-value generator 36 are reset to their initial values.

In the embodiment shown in FIG. 3, the output quantity GF of block 39 for generation of the global factor and the control factor RF issuing from controller 35 do not act separately on the anticipatory control value te from characteristic field 12 via respective multiplication points but are combined in a separate multiplication or adding point 40 from where they influence jointly the value te in the sense of an overall correction in multiplication point 41. In the embodiment of FIG. 3, the global factor GF is therefore obtained from the value of the averaged control factor, in the manner explained in more detail in the following.

Method I for Determining Global Factor GF:

On the occurrence of a change in the characteristic field, the magnitude of change is established, with a selectable, that is, predeterminable percentage of this change being incorporated into global factor GF. Each control value obtained or interpolated from the characteristic field is then multiplied by this global factor GF (via operation or multiplication points 40, 41), so that the factor acts like a multiplicative shift of all support points.

In accordance with FIG. 3, integral controller 35 generates from the control difference the control factor RF which, via 40, 41, acts continuously multiplicatively on the correcting quantity interpolated from the characteristic field. Initially, for adaptation of the characteristic field, the averaged control factor $\overline{RF}$ is incorporated into the characteristic field with a change in engine speed or throttle flap position, as a result of which a departure from the range of influence of a support point occurs. This is accomplished according to the following formula:

$$SS_{new}=SS_{old}.RF,$$

wherein SS=support point value.

The derivation of this formula will be explained below; at the same time, part of this correction will also enter into global factor GF. For this purpose, block 39 is suitably configured for the generation of the global factor, for example, as a microprocessor or microcomputer, in order to execute the necessary computations. The global factor is determined according to the following approximation formula:

$$GF_{new}=GF_{old}+a.(\overline{RF}-1),$$

wherein a=influence factor.

According to this formula, the global factor receives an integral action having a large time constant. Since the global factor is only changed with the adaptation of the characteristic field, it is ensured that a larger characteristic field range is referred to for the determination of the global factor. As shown at 40 in FIG. 3, the global factor and the control factor are multiplied to form an overall correction quantity which acts (at 41) likewise multiplicatively on the control value interpolated from the characteristic field.

Generally, changes affecting the values of the desired characteristic field can be caused by influences acting preferably multiplicatively, which account for the majority of characteristic field changes, but also additively on the entire characteristic field or by influences altering the structure of the characteristic field. Investigations have shown that, although the two influencing quantities can be separated only in part, they can be corrected in an optimal manner by making the support point and the global factor follow the desired pattern. However, the transient time increases, the more completely a multiplicative influence on the characteristic field is determined by the global factor. Therefore, a compromise is desirable with an about 50% multiplicative influence by the global factor, whereas the remainder is taken into account by support point changes. The introduction of the global factor in addition to the support-point adaptation results in a substantially improved adaptation of the characteristic field.

If the vehicle is parked for prolonged periods of time, a relatively strong shift of the characteristic field may occur which is attributable to changed air pressure, temperature, and the like. If such a shift partly enters into the characteristic field after the start, before the new global factor is determined, it may happen that an already correctly adapted characteristic field structure becomes adulterated in the process. The invention therefore provides means to exclusively determine the global factor for a specific time after the start, using for this purpose the range protector 37. Only when the new value of the global factor has been determined is the characteristic field again updated. On the other hand, in order to avoid that the global factor is newly determined in cases where the vehicle is stopped only for a brief time, the above-described function for determining the global factor will not be activated until after warm-up of the internal combustion engine.

The determination and computation of the global factor GF can be accomplished according to the following basic principle:

With each adaptation of the characteristic field, a predeterminable percentage a of the control factor enters into the global factor according to the following formula or rule:

$$GF_{new}=GF_{old}.f(a,\overline{RF}), \quad (1)$$

the requirement being that the entire averaged control factor is to enter into the global factor after rule (1) has been applied 1/a times.

$$f(a,\overline{RF})1/a=\overline{RF}$$

or $$f(a,\overline{RF})=\overline{RF}a \quad (2)$$

That is, with each adaptation the global factor is multiplied by RFa.

$$GF_{new}=GF_{old}.\overline{RF}a \quad (3)$$

After interpolation, the control value taken from the characteristic field is additionally multiplied by the new global factor:

$$\text{Correcting Quantity}=SS.(\overline{RF}.GF),$$

where SS is the control or support point value from the characteristic field.

In order to avoid a jump in the correcting quantity, the entire control factor therefore must not be incorporated into the characteristic field.

Requirement: Old Correcting Quantity = New Correcting Quantity, or:

$$SSa.\overline{RF}a.GFa=SSn.\overline{RF}n.GFn=SSn.1.(GFa.\overline{RF}aa)$$

(with 3) it becomes $$SSa.\overline{RF}a=SSn.\overline{RF}aa$$

$$SSn=SSa.\overline{RF}a/\overline{RF}aa$$

$$SSn=SSa.\overline{RF}a(1\text{-}a) \quad (4)$$

Comments on (3): When applied to a motor vehicle, the global factor may be approximated according to the following rule (5) in order to reduce the computing complexity (approximation satisfactory with GF ~ 1):

$$GF_{new}=GF_{old}+a.(\overline{RF}\text{-}1) \quad (5)$$

Comments on (4): In practice, a very small influence factor a is chosen: $a<<1$. Therefore, it is negligible with good approximation towards 1, and $$SS_{new}=SS_{old}.\overline{RF}$$

(6) is obtained, as mentioned above.

Further investigations have shown that in the method of computation described above, the uniform portion of a characteristic field correction enters into the global factor only in part because this portion is transferred into the characteristic field as long as the global factor has not yet reached its final value.

Figure 4:
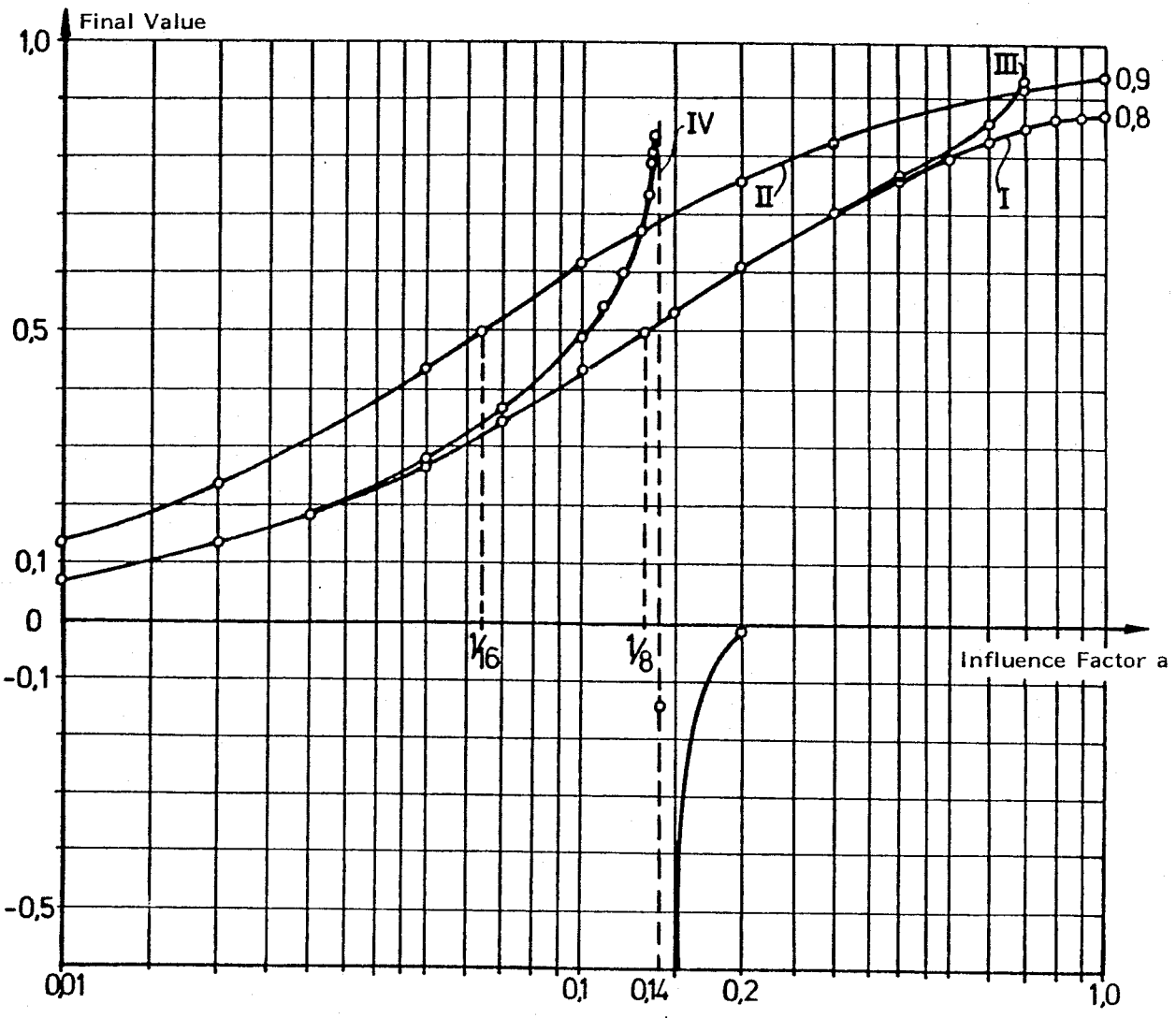
FIG. 4 is a graph showing curve shapes for attaining the final value of the global factor in dependence upon an influence factor serving for its computation.

The diagrams of FIGS. 4 to 7 relating to final value and transient behavior of the global factor (with a different influence factor in FIG. 7) result from further measurements and investigations conducted to clarify how a uniform variation is distributed in practice to the global factor and the characteristic field. For this purpose, an actual characteristic field (corresponding to the characteristic field of the control device), a desired characteristic field (corresponding to the ideal values for the engine), and a pass generator (corresponding to the driving curve produced by the vehicle operator) were defined, and the learning strategy indicated in the rules (5) and (6) referred to above was used as the basis. The verification can be carried out by a computer simulation, permitting a possible pass of the characteristic field to be reduced to a pass of one characteristic curve without affecting the distribution of the uniform portion of the characteristic field correction. The pass generator generates the address of the actual support point of the characteristic field. The quotient of the desired and the actual support point is directly used as a correction factor and distributed to the global factor and the characteristic field by the respective learning strategy. The procedure (simulation) continues until the system has reached a steady state, that is, until the global factor stops changing. When using various parameters, for example, the influence factor, the number of active support points addressed by the pass generator, the magnitude and structure of the deviation of the desired characteristic field from the actual characteristic field, the type of pass (sequential, random), then the curve patterns shown in FIGS. 4 to 7 will result. In FIG. 4, the portion of uniform deviation entered into the global factor is shown, scaled to the total deviation of the desired characteristic field, and plotted against influence factor a; the influence factor a is plotted logarithmically. In FIG. 4, the characteristic curve I relates to eight active support points, with:

$$GF=GF+a(\overline{RF}-1)\ \text{Correction}=\overline{RF}.GF;$$

characteristic curve II relates to 16 active support points under the same conditions, characteristic curve III to an approximation without multiplication, division with 20% deviation, and characteristic curve IV relates to a 100% deviation.

Figure 5:
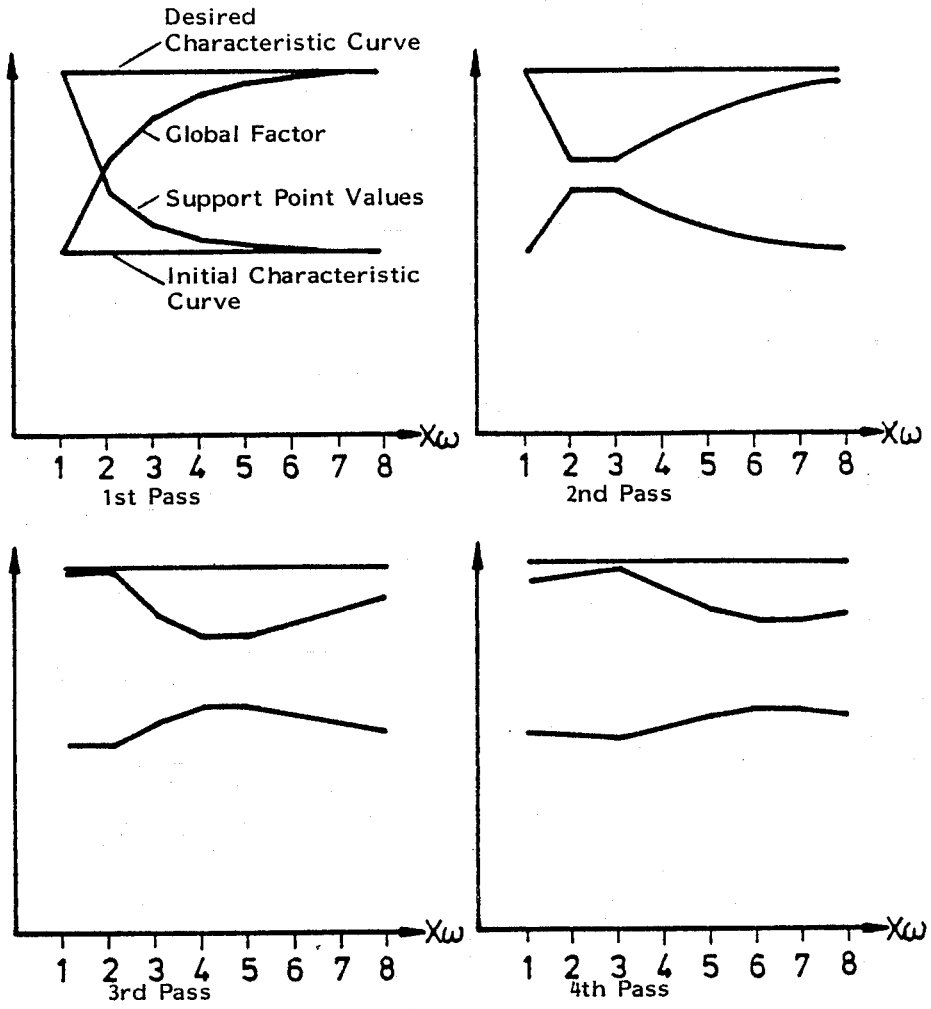
FIGS. 5 and 6 are graphs showing the transient behavior of the global factor in dependence upon the number of passes, based upon a method of calculation and a predetermined value of the influence factor.
Figure 6:
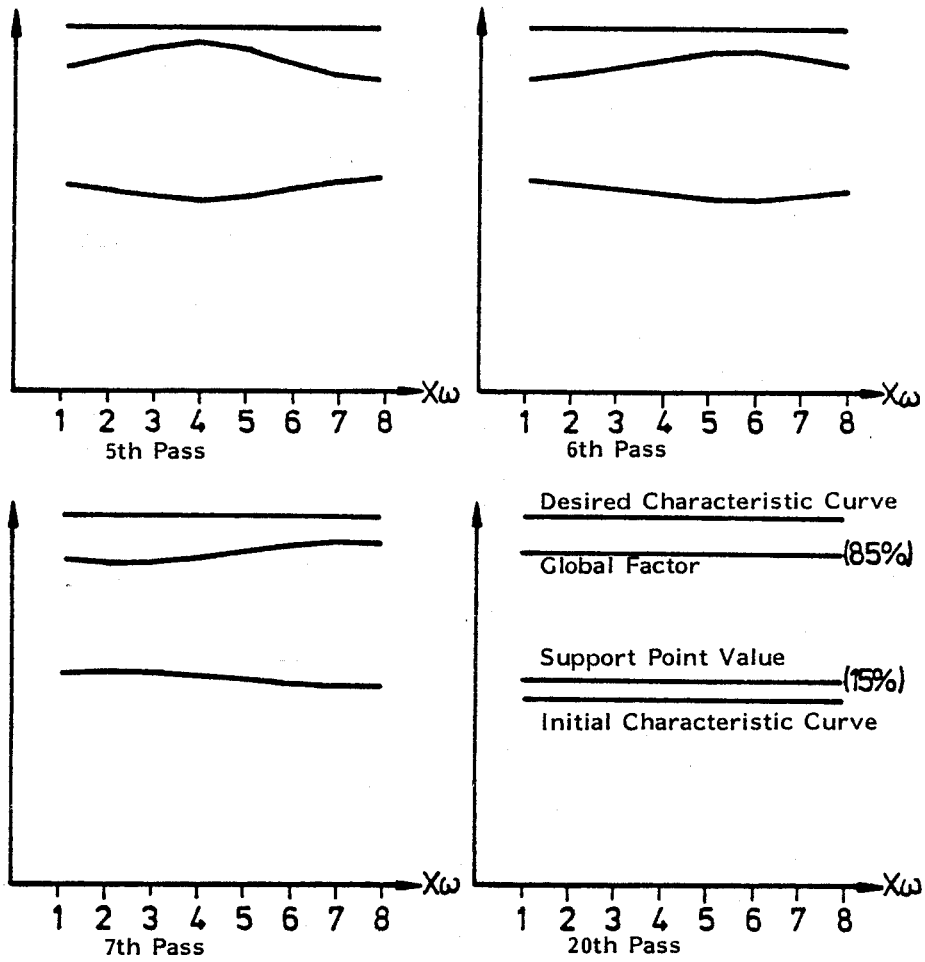
Figure 7:
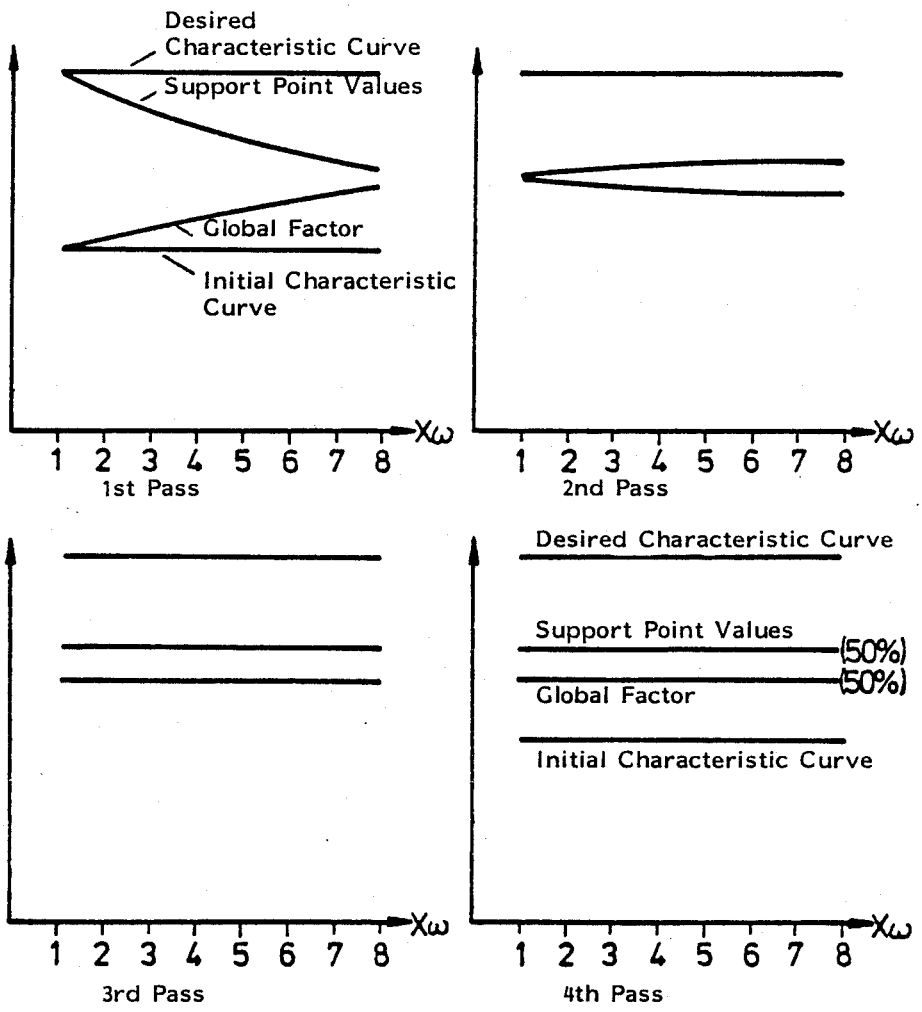
FIG. 7 is another graph showing the transient behavior of the global factor at another value of the influence factor.

The curve patterns of FIGS. 5, 6 and 7 show the different stages of two simulation runs. The diagrams show the sequentially passed characteristic curve (support points 1 to 8) and the values of the support points and of the global factor during a pass from SS1 to SS8. At a large influence factor of a=0.5 (FIGS. 5 and 6), the major part of the variation is determined by the global factor (final value after the 20th pass=80%); however, the system takes substantially longer to reach its steady state (20 passes at a=0.5, compared to four passes at a=0.0625), and the transient procedure proceeds less smoothly.

The following calculations refer to the resulting final value which depends on various influence quantities:

(a) E=f(a.SSA), where E=final value of global factor; and SSA=number of active support points.

The final value is dependent on the product of the influence factor by the number of active support points. Double a and half the number of active support points yield the same final value.

This dependent relationship, however, applies only to the linear section of the characteristic curves of FIG. 4 (with final value=50%, turning point).

| | |
|---|---|
| (b) E = 0 | for a = 0 |
| (c) E = 0.5 | for a = 1/SSA |
| (d) E = 1-1/SSA | for a = 1 (continuous oscillation) |

The maximum attainable final value depends directly on the number of active support points. With SSA=8, it amounts to 87.5% of the uniform characteristic field variation; with SSA=16 it is 93.75%; with SSA=20, it is 95%, etc.

(e) E=1 which is for an infinite number of support points.

(f) E=f(SSK/SSA)

wherein SSK=number of support points to be corrected.

The final value is dependent on the ratio of the support points to be corrected to the total number of active support points. If only one fourth of the active support points is subjected to a correction, the global factor accordingly amounts to only one fourth of the possible final value.

General Remarks: If the amount of correction varies from one support point to the next, the mean value of all corrections can be referred to for the computation of the final value of the global factor.

(g) E=f(1/n.Σcorr.i)

wherein:Σcorr.i=sum of individually differing support point corrections.

(h) The final value is independent of the type of pass involved.

However, the transient period differs. In sequential passes proceeding according to SS1→SS8, SS1→. . . , the transient period is shorter than in sequential forward/backward passes SS1→SS8, SS8→SS1, SS1→. . . .

If a pseudo-random generator is used for address predetermination, a shorter transient period results for large influence factors ($a>\frac{1}{3}$), whereas the transient period becomes longer for small influence factors.

If the global factor is computed multiplicatively according to the above formula (3), it is determined as follows:

$$GF_{new}=GF_{old}.RF^{a},$$

with lower final values resulting than in the additive computation method according to formula 5. The factor is:

$$E_{mult}(SS.EF)=E_{add}\ (SS.EF/1.4)$$

The shape of the final-value characteristic curve corresponds (around E=0.5) to the curve shape resulting from additive computation. The transient period is nearly identical.

When applied in a motor vehicle, a method without the need for multiplication and division is more appropriate for reasons of computing time. In this case, the correcting quantity interpolated from the characteristic field is not additionally multiplied by the global factor, but control factor and global portion are added to the interpolated characteristic value prior to the multiplication.

$$\text{Correcting Quantity}=SS.(RF+GF)$$

Adaptation of the Characteristic Field:

$$SS_{old}.(RF+GF)=SS_{new}.(1+GF)$$

$$SS_{new}=SS_{old}.[(RF+GF)/(1+GF)]$$

To compute the new support point, a division is thus necessary. As in the multiplication of control factor by global factor, this complex computation can be approximated by applying equation (6):

$$SS_{new}=SS_{old}.RF$$

In this method, the same final values result as in the support point computation involving a division. The transient period is even substantially shorter.

However, in the additive computation the final value generally depends on the magnitude of the necessary support point correction. In the presence of a large correction and a large influence factor, substantially higher values result for the global factor than is to be expected according to characteristic curve I of FIG. 4 (see characteristic curves III and VI).

If a 100% shift of the characteristic field occurs, the global factor becomes negative starting with an influence factor of a=0.14. In addition, the transient period becomes substantially longer.

In such a method, therefore, the influence factor should not be selected larger than a=0.1 if the possibility of characteristic field shifts exceeding 20% exists.

Self-adaptation using the factor characteristic field will be discussed below.

Figure 8:
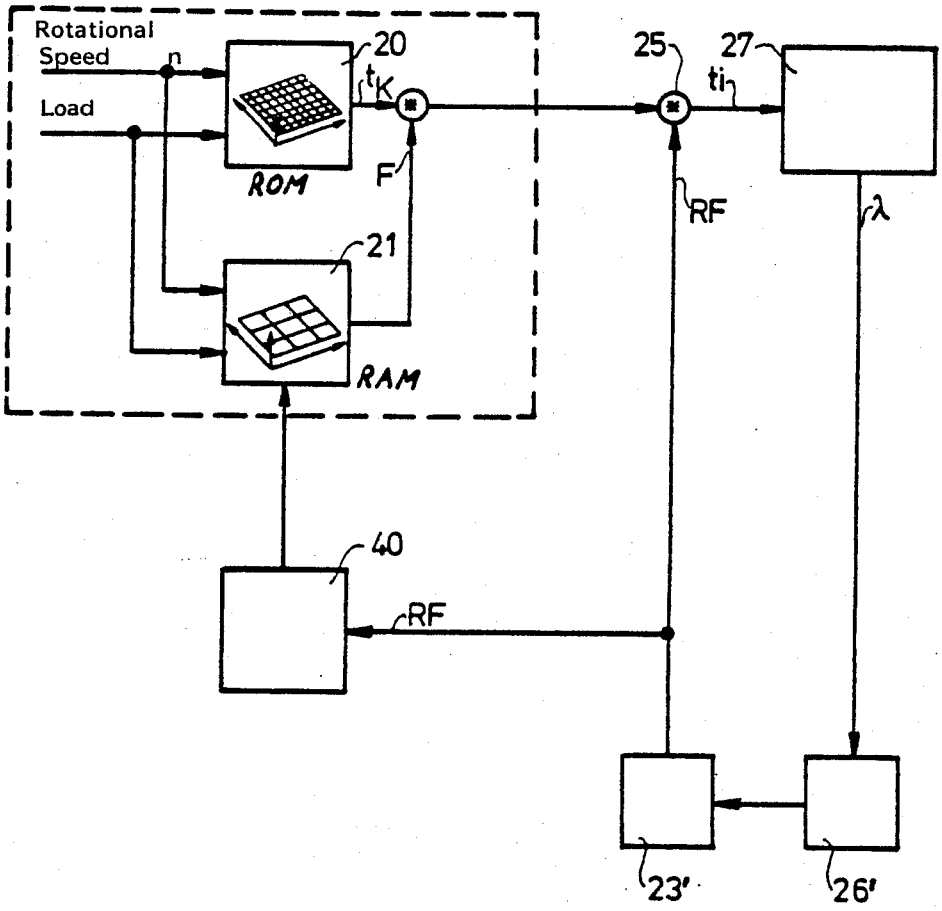
FIG. 8 is a block diagram of another embodiment of a self-adaptive anticipatory control, wherein the self-adaptation is carried out by means of a factor characteristic field.

The block diagram of FIG. 8 shows the basic principle of a self-adaptive characteristic field (learning anticipatory control) in a simplified schematic; the characteristic field range is subdivided into the basic characteristic field 20, preferably in the form of a read-only memory (ROM). In the ROM, the relevant data is stored in the form of support points, with intermediate values being computable by a linear interpolation. The number of support points and interpolated intermediate values is determined in accordance with the required quantization for the control method involved; in the determination of fuel-injection values which in this embodiment also serve to explain the invention, the quantization can be selected such that the characteristic field includes 16×16 support points with 15 intermediate values between any two support points.

The self-adaptation is accomplished by means of second or separate factor characteristic field 21, preferably configured as a random-access memory (RAM) and serving to store the self-adaptation values. The basic characteristic field is subdivided into ranges, with each range being assigned a factor from the factor characteristic field 21. The interpolated initial value of the basic characteristic field 20 is then multiplied by the corresponding factor or by a value interpolated from several factors at multiplication point 22 in the embodiment of FIG. 8. In this embodiment, 8×8 factors are provided for the factor characteristic field, each having the initial value 1.0 and being subject to changes in the course of the adaptation process.

The final injection value is then obtained from a multiplication operation involving the basic value $t_K$ issued by the basic characteristic field, the factor F from factor characteristic field 21, and the actual control factor RF from the control loop (subsequent multiplication point 25), as well as a further factor, possibly a correction factor, as follows:

$$ti=t_K.F.RF$$

With a change of the operating point into another range with another factor F of factor characteristic field 21, a jump occurs in the output quantity which, should it be disturbing, can be avoided by a suitable setting of the control factor RF. It may also be useful to interpolate between the individual factors F in factor characteristic field 21; the impact of such an interpolation on the learning process will be discussed below. The factors stored in factor characteristic field 21 are adapted according to the following formula:

$$F_{new}=F_{old}.\overline{RF}$$

Therefore, as long as a range in basic characteristic field 20 is accessed, the control factor RF is averaged and the associated factor F is modified via block 40, learning method for the factor characteristic field.

Figure 9:
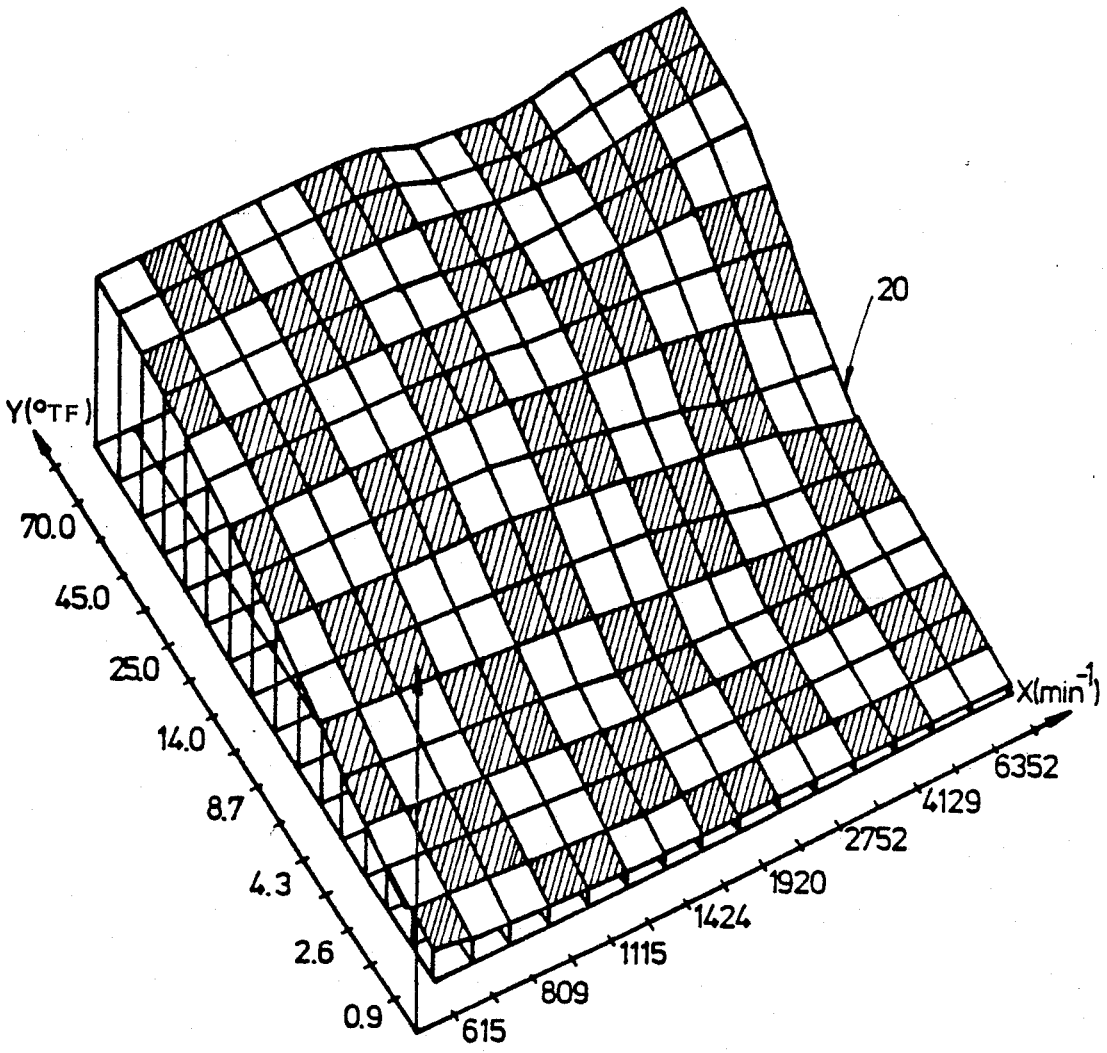
FIG. 9 is a three-dimensional representation showing, by way of example, the dependence of fuel-injection pulses on throttle flap position and rotational speed (anticipatory control range - ti - characteristic field)

In this connection, reference is first made to FIG. 9 showing a possible basic characteristic field 20 having 16×16 support points. This basic characteristic field 20 shows in numerical values the respective durations of fuel-injection pulses ti in dependence on the throttle flap position TF (=Y) and the rotational speed n (=X). The characteristic field of FIG. 9 shows hatched and non-hatched areas (total of 64 ranges), each indicating a corresponding range for which a common factor is stored in factor characteristic field 21. As already mentioned, the factor characteristic field includes 8×8 factors in this embodiment, and the division of the ranges shown in FIG. 9 can be arbitrarily selected.

Figure 10:
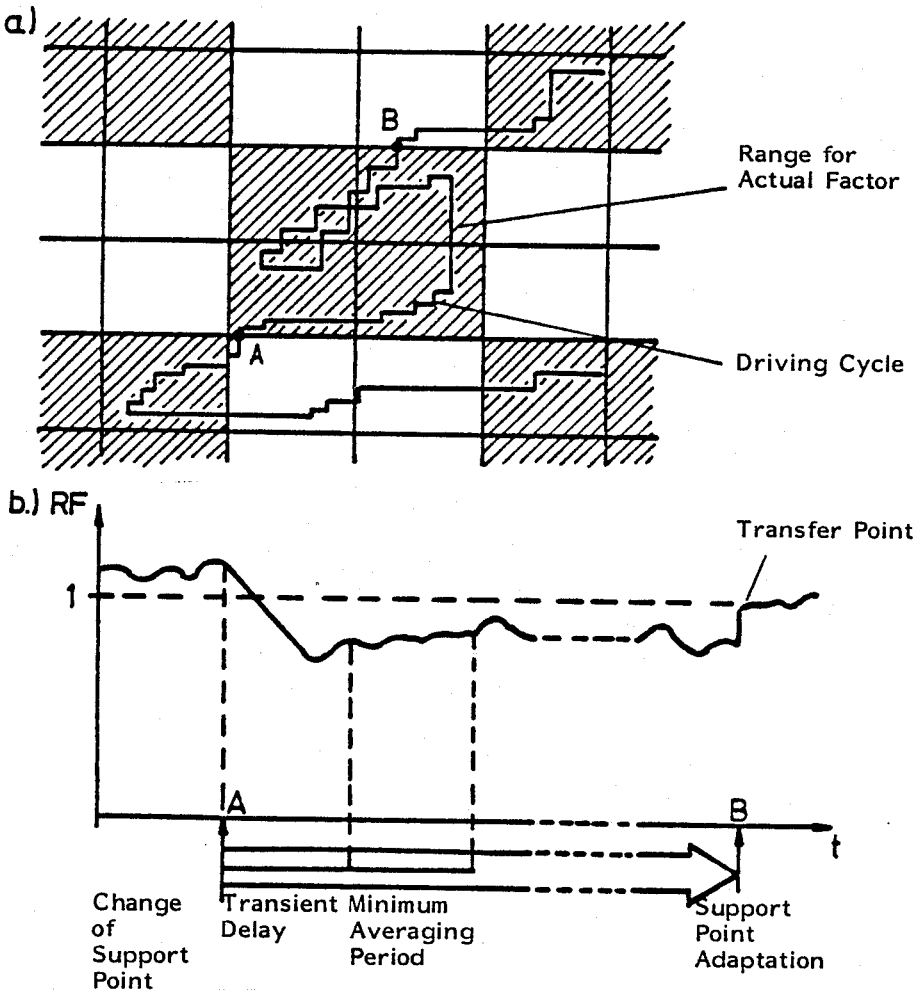
FIG. 10*a* is a detailed view of the basic characteristic field, showing the driving curve and the environment of an actual support point.
FIG. 10*b* is a graph showing the control factor plotted against time and the transfer point for support-point adaptation.

The adaptation process for a factor is then performed as illustrated schematically in FIG. 10. FIG. 10*a* thereof is a detail of the basic characteristic field 20 showing a driving curve and the respective range for the selected individual factor. The driving curve enters this range at A, leaving it again at B.

Correspondingly, FIG. 10*b* shows the course of control factor RF against time. After entering the range at A, the control factor is averaged following a predeterminable transient delay, with a predetermined minimum averaging period being required which is also indicated in FIG. 10. When the driving curve leaves the range at B or after a predeterminable averaging period has elapsed, the averaged control factor $\overline{RF}$ is included in the computation of factor F according to the formula shown above.

On account of the predetermined transient delay and the minimum averaging period, a distinction is made between stationary and dynamic operating points. It has already been mentioned that the adaptation makes sense only in the stationary range which is additionally disrupted on warm-up, after start, in the overrun cutoff mode of operation and on acceleration enrichment. These tasks can also be provided by range detector 37 of FIG. 3, it being understood that the relevant functional sequences can be executed and thus implemented wholly or in part in the form of programs, for example, using suitable computer systems, microcomputers, or the like.

On the basis of appropriate control methods, the arrangement of factor characteristic field 21 permits the correction of all adaptation errors of basic characteristic field 20. All these corrections become effective only in such sub-ranges which are accessed not too rarely in the stationary operation. Therefore, it is an advantageous embodiment of the invention to consider additive and/or multiplicative disturbances optimally and complementary to the arrangement of a factor characteristic field by also providing for the consideration and correction of uniform disturbance portions through the principle of the generation of a global factor.

The table below shows the disturbances acting substantially multiplicatively and additively as well as their character when used in combination with an alphanumeric system (throttle flap position and rotational speed as main input quantities for the calculation of the duration of injection). The periods of time vary in which these disturbances may change.

| Disturbance | Mult. | Add. | Time Constant Slow/Fast | Controlled Correction |
|---|---|---|---|---|
| Air Temperature | X | | X–X | Yes |
| Air Pressure | X | | X–X | No |
| Fuel Pressure | X | | X | No |

-continued

| Disturbance | Mult. | Add. | Time Constant Slow/Fast | Controlled Correction |
|---|---|---|---|---|
| (dependent on controller) | | | | |
| Fuel Pressure (dependent on $U_{Batt}$) | X | | X | Yes |
| Valve Opening | X | | X | No |
| Valve (operating/ valve pull-in times) | | X | X | No |
| Potentiometer Adjustment | | X | X-X | No |
| Flap Contamination (Multipoint) | | X | X | No |
| Temperature Difference (Flap/Intake Pipe) | | X | X | Partly |
| Tank Venting | | X | -X- | No |
| Crankcase Venting | | X | -X- | No |
| Fuel Quality | X | | ---X | No |

Figure 11:
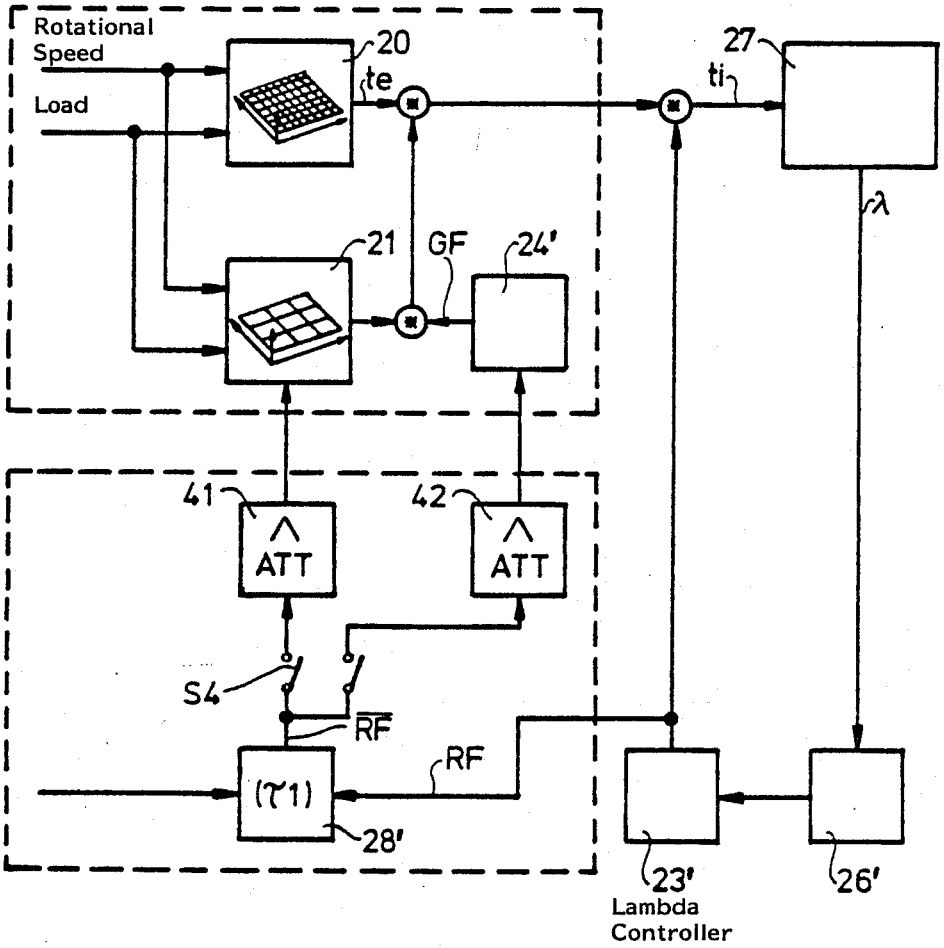
FIG. 11 is a block diagram showing a first embodiment for determining the global factor from the control factor.

FIG. 11 shows in greater detail the determination of the global factor already referred to initially. This first determination method consists of connecting the control factor averaged in block 28' via a dual switch S4 to two parallel attenuators 41, 42. The control factor is then applied separately to factor characteristics field 21 already known from FIG. 8 and block 24' for the global factor which can be configured as a random-acess memroy (RAM) as can the factor characteristic field. Control factor RF is averaged as long as the operating points remain within a defined range of basic characteristic field 20. At predetermined time intervals or whenever a departure from the defined range occurs, factor F will be adapted, with the global factor GF being changed only with a change of the defined range. The adaptations for the new factor F of the factor characteristic field and the new global factor proceed according to the formulae given below in which always part of the mean control deviation is incorporated into the associated factor while another part enters into the global factor.

$$F_{new} = F_{old}\,1 + (RF - 1)\cdot a \approx F_{old} + (RF - 1)\cdot a$$

$$GF_{new} = GF_{old}\,1 + (RF - 1)\cdot b \approx GF_{old} + (RF - 1)\cdot b$$

$$a + b \leqq 1$$

Figure 12:
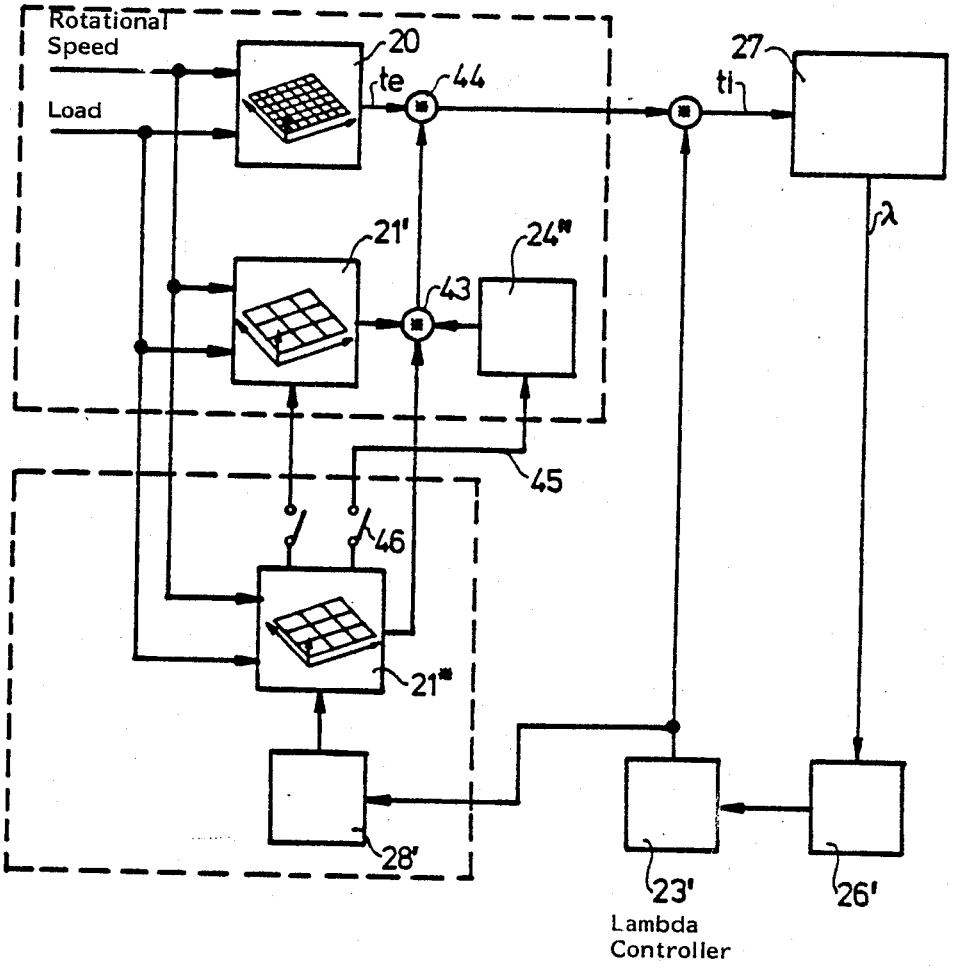
FIG. 12 is a block diagram showing a second embodiment for determining the global factor from an additional factor characteristic field and the interactions of the individual quantities for influencing the anticipatory control value issued.
Figure 13:
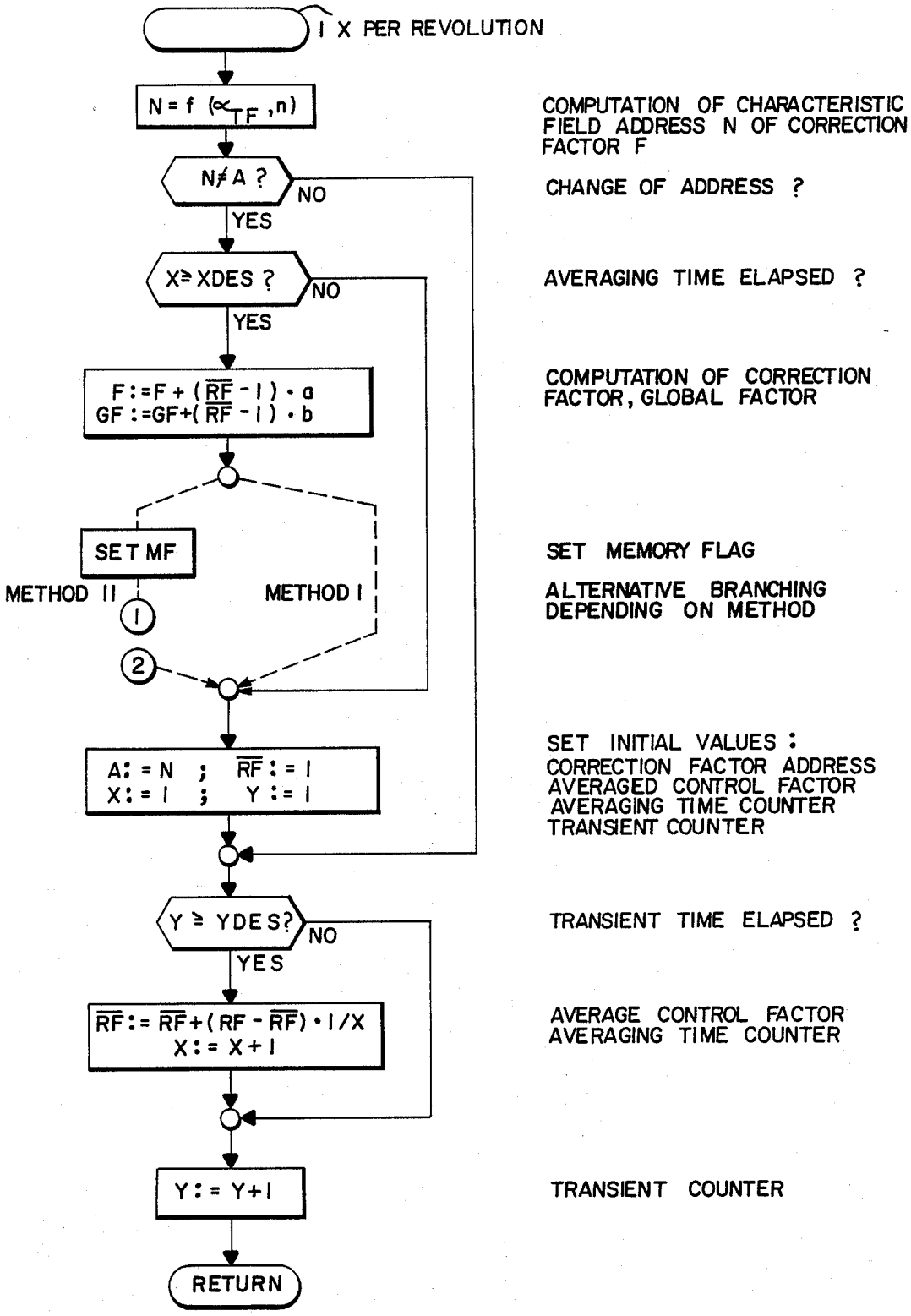

The succession of steps in this learning method for the determination of the global factor according to FIG. 11 is represented in the form of the flowchart in FIG. 13. While this method is identified as method I, a further method for determining the global factor is referred to as method II. Including two sub-variants, method II is represented in the block diagram of FIG. 12 and in the flow chart of FIG. 14 which forms an addition to the flow chart of FIG. 13.

In the block digram of FIG. 12 it will be noted that additional second factor characteristic field II, identified by reference numeral 21*, is provided. The same input data (here rotational speed and load) as addresses are applied to second factor characteristic field 21* parallel to basic characteristic field 20 and first factor characteristic field I (reference numeral 21'). The second factor characteristic field acts likewise multiplicatively on the basic characteristic field through a first multiplication point at 43 and a second multiplication point at 44 where an overall correction factor acts on value te issued by basic characteristic field 20. On start of the internal combustion engine, factor characteristic field II is set to 1.0, followed by continuous adaptation. Factor characteristic field I and the global factor will not change initially. In addition, a flag characteristic field is provided to store the factors which are accessed.

Factor characteristic field II will then be evaluated at predetermined longer time intervals, with the deviation of the mean value of all factors from the initial value 1.0 being incorporated into the global factor (connecting line 45 via a switch 46). The remaining structural deviation from 1.0 will be incorporated into factor characteristic field I, with only the factors accessed being considered. Subsequently, factor characteristic field II will be reset to 1.0 and a new adaptation cycle begins. The formulae valid for the determination of the global factor applying method II are as follows:

$$GF_{new} = GF_{old}\cdot\frac{1}{n}\sum_{1}^{n} F_{II} \approx GF_{old} + \left[\frac{1}{n}\sum_{1}^{n}(F_{II} - 1)\right]$$

The modified support points $F_{II}$ become:

$$F_I = F_{II}\cdot\frac{1}{\frac{1}{n}\sum_{1}^{n} F_{II}} \approx F_{II} - \left[\frac{1}{n}\sum_{1}^{n}(F_{II} - 1)\right]$$

A program for this determination method II is made up of two parts. The first part corresponds to method I in FIG. 13 including the alternative shown therein without consideration of the global factor (b=0). The second part is a supplementary subprogram of method I and is shown as a flowchart in FIG. 14, the numbers in the circles indicating where the insertions are to be made.

Figure 15:
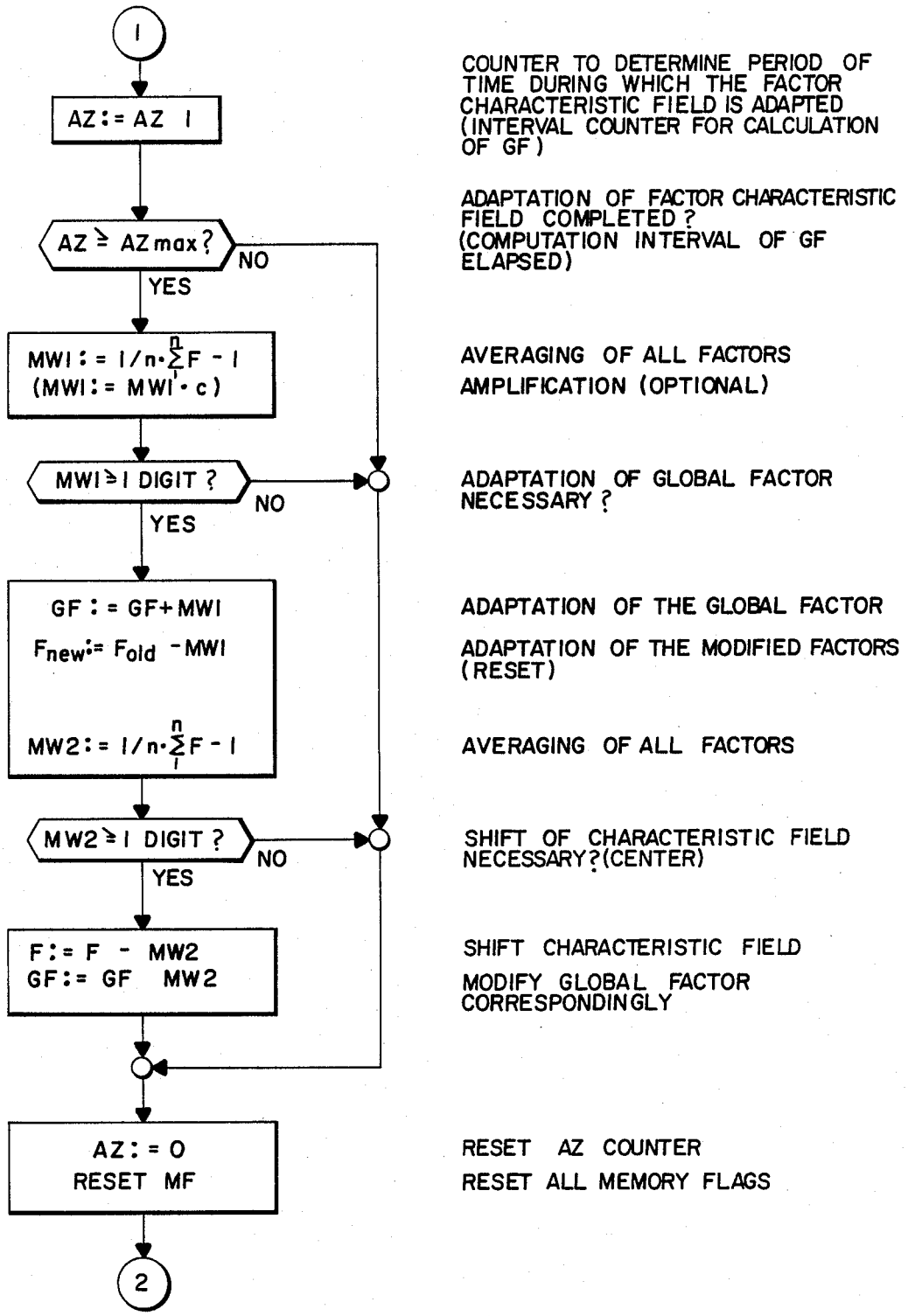

Finally, it is possible to represent method II for determination of the global factor in software terms such that the random-access memory for factor characteristic field II can be dispensed with and all computing steps are executed with factor characteristic field I only; a partial flowchart for this method is shown in FIG. 15.

All the features represented in the description, the subsequent claims and the drawings may be essential to the invention both singly and in any combination thereof.

It is understood that the foregoing description is that of the preferred embodiments of the invention and that various changes and modifications may be made thereto without departing from the spirit and scope of the invention as defined in the appended claims.

What is claimed is:

1. An apparatus for adaptively controlling operating characteristic quantities of an internal combustion engine, the apparatus comprising:

basic memory means having operating characteristic quantities dependent on engine parameters stored therein and being addressable by said parameters;

said memory means delivering open-loop precontrol operating quantities;

means resposive to at least one engine variable and generating an actual value thereof;

a controller receiving said actual value and forming a control factor (RF);

mean value formation means connected to the controller and forming an averaged control factor value ($\overline{RF}$) which is transformed into a global factor (GF);

multiplier means receiving said global factor (GF) for adaptively correcting every memory-stored open-loop precontrol operating quantity issued by said memory means in the sense of multiplicative shifting of the total data in said memory means; and, closed-loop control means including said controller for finally correcting every precontrol operating quantity already adaptively corrected by said global factor.

2. An apparatus for adaptively controlling operating characteristic quantities of an internal combustion engine, the apparatus comprising:

basic memory means having operating characteristic quantities dependent on engine parameters stored therein and being addressable by said parameters;

said basic memory means delivering open-loop precontrol operating quantities;

means responsive to at least one engine variable and generating an actual value thereof;

a controller receiving said actual value and forming a control factor (RF);

mean value formation means connected to the controller and forming an averaged control factor value ($\overline{RF}$);

factory memory means being provided in addition to said basic memory means;

said factor memory means being influenceable by said averaged control factor value ($\overline{RF}$) and being addressable in parallel by the same parameters which address said basic memory means and every factor (F) of said factor memory means being adapted to correct the precontrol operating quantities issued from said basic memory means within a specific region thereof;

means for evaluating the data of said factor memory means to establish a global factor (GF);

multiplier means receiving said global factor (GF) for adaptively correcting every memory-stored open-loop precontrol operating quantity issued by said basic memory means in the sense of multiplicatively shifting the data in said basic memory means; and, closed-loop control means including said controller for finally correcting every precontrol operating quantity already adaptively corrected by said global factor.

3. A method for adaptively controlling operating characteristic quantities of an internal combustion engine, the method comprising:

storing operating characteristic quantities dependent on engine parameters in a basic memory addressable by said parameters;

issuing open-loop precontrol operating quantities from said basic memory;

generating an actual value corresponding to at least one engine variable;

supplying said actual value to a controller and forming a control factor (RF);

forming an averaged control factor value ($\overline{RF}$) which is transformed into a global factor (GF);

supplying said global factor (GF) to a multiplier for adaptively correcting every memory stored open-loop precontrol operating quantity issued by said basic memory in the sense of multiplicatively shifting the total data in said memory; and, fianlly correcting every precontrol operating quantity already adaptively corrected by said global factor by means of a closed loop which includes said controller.

4. A method for adaptively controlling operating characteristic quantities of an internal combustion engine, the method comprising:

storing operating characteristic quantities dependent on engine parameters in a basic memory addressable by said parameters;

issuing open loop precontrol operating quantities from said basic memory;

generating an actual value corresponding to at least one engine variable;

supplying said actual value to a controller and forming a contorl factor (RF):

forming an averaged control factor value ($\overline{RF}$):

influencing a factor memory by means of said averaged control factor value ($\overline{RF}$) and said factor memory being addressable in parallel by the same engine parameters which address said basic memory and every factor (F) of said factor memory being adapted to correct the precontrol operating quantities issued from said basic memory within a specific region thereof;

evaluating the data of said factor memory to establish a global factor (GF);

supplying said global factor (GF) to a multiplier for adaptively correcting every memory stored open-loop precontrol operating quantity issued by said basic memory in the sense of multiplicatively shifting the data in said basic memory; and, finally correcting every precontrol operating quantity already adaptively corrected by said global factor by means of a closed loop which includes said controller.

5. The method of claim 4, wherein the global factor and the averaged control factor value ($\overline{RF}$) conjointly arithmetically influence the particular control factor ($t_e$) issued by the basic memory, said global factor being determined by averaging of the control factor with the said of a predetermined influence factor (a) and being for the arithmetical total displacment of the basic memory values.

6. The method of claim 4, wherein the following are evaluated as actual values of the engine variables: lambda value, the quiet-running of the engine, the rotational speed of the engine and the like, and, with the formed control factor (RF), influences the control value and, parallel via the averaged control factor, the self adaptation of the anticipatory control.

7. The method of claim 4, wherein disturbing quantities (air temperature, air pressure, fuel pressure, fuel quality, et cetera) acting primarily multiplicatively are considered by the golobal factor (GF) and primarily additively acting disturbing quantities (valve drop, pull-in times, potentiometer adjustments, flap-closure, tank ventilation, et cetera) are considered by means of individual factors of a factor memory assigned to the basic memory, said global factor influencing multiplicatively the entire basic memory.

8. The method of claim 4 wherein, to determine the individual factors (global factor and a factor from the factor memory) from the averaged control factor ($\overline{RF}$), the control factor is supplied so long as the operating point reached by the engine lies in a predetermined influence region of the basic memory, and the factors (global factor and factor from the factor memory) are changed with a change of influence region during the working in of a predetermined portion of the average control factor.

9. The method of claim 8, wherein a part of the averaged control factor ($\overline{RF}$) is worked into the global factor and a part is worked into the factor of the factor memory.

10. The method of claim 4, wherein the adaptation of the factor (F) of an additional factor memory is effected by means of adding the average control deviation factor ($\overline{RF}$) while at the same time by defining a predetermined influence region within the basic memory with the operating characteristic quantities being supplied parallelly to the additional factor memory as addresses, the operating characteristic quantities being supplied to the basic memory for issuing the anticipatory control quantities, with the adaptation occurring either in a predetermined time intervgal or when leaving the defined influence region in the basic memory and with a predetermined portion of the average control deviation in the associated factor (F) of the additional factor memory.

11. The method of claim 10, the basic memory is formed from a read store (ROM) and the additional factor memory of a write-read store (RAM).

12. The method of claim 11, wherein after the driving curve is entered in a predetermined influence region, the control factor is first averaged after a predetermined time delay and thereafter a predetermined minimal averaging time is adhered to and thereafter either when leaving the influence region or after a predetermined averaging time, the average control factor is added in the factor (F) of the additional factor memory, said factor (F) being responsible for this influence region.

13. The method of claim 4, wherein a further, second factor memory II is defined for multiplicatively acting on the basic memory with this second factor memroy II being set at start to a predetermined starting value (1.0) and continuously adapted with at first unchangedly holding the value in the first additional factor memroy I and the global factor and at predetermined larger time intervals, the additional second factor memory 11 is evaluated, the deviation of the average value of all factors from the initial value being worked into the formation of the global factor and the remaining structural deviation from the initial value being worked into the first factor memory I with only the controlled factors being considered, whereupon the additional second factor memory II is again set to the predetermined initial value and a new adaptation process is started.

14. The method of claim 13, wherein an internal combustion engine of any desired type is used, especially diesel engines or OTTO engines with fuel metering (controlled carburetor) or with intermittent or continuous injection (Wankel engine, Stirling engine, gas turbine or the like).

15. The method of claim 4, the method being applied in at least one of the systems for the metering of the air/fuel mixture, controlling the ignition timing, charging pressure control, return flow of the exhaust gas, idle control or the like.

16. The apparatus of claim 2, wherein the global factor (GF) and the factor (F) originating from said factor memory means (21, 21') are joined for a pregiven influence region and are directed to a common multiplier location (44) for effecting a total correction of the control value in the sense of a self-adaptive anticipatory control, said control value being issued by said basic memory means.

17. The apparatus of claim 2, wherein a further factor memory means (21*) is provided in addition to a first additional factor memory means (21') which is charged directly by the average control factor value ($\overline{RF}$) with the deviation of the mean value of all factors of the additional factor memory means being evaluated in pregiven time intervals for forming the global factor and the remaining structural deviations from an initial value being worked into the values, of the first additional factor memory means (21, 21').

18. The method of claim 4, wherein additionally to the basic memory formed by a permanent value storage unit (ROM), a supplementary factor memory is provided for correcting control values within a specific region of the basic memory, said factor memory being addressed in parallel to the basic memory; and, wherein the control value is arithmetically corrected by means of the global factor and via the selectively acting value (F) of the additional factor memory, said control value being issued by the particular basic memory and being selected by means of addressing via predetermined operating characteristic quantities of the engine such as rotational speed, load, air quantity and throttle flap position.

19. The method of claim 4, wherein additionally to the basic memory formed by a permanent value storage unit (ROM), a supplementary factor memory is provided for correcting control values within a specific region of the basic memory, said factor memory being addressed in parallel to the basic memory; and, wherein the control value is arithmetically corrected by means of the global factor and via the selectively acting value (F) of the additional factor memory, said control value being issued by the particular basic memory and being selected by means of addressing via predetermined operating characteristic quantities of the engine such as rotational speed, load, air quantity and throttle flap position.

* * * * *

UNITED STATES PATENT AND TRADEMARK OFFICE

CERTIFICATE OF CORRECTION

PATENT NO. : 4,827,937

DATED : May 9, 1989

INVENTOR(S) : Rolf Kohler, Peter Schmidt and Manfred Schmitt

It is certified that error appears in the above-identified patent and that said Letters Patent is hereby corrected as shown below:

In column 7, line 18: delete "quantit $Q_K$" and substitute -- quantity $Q_K$ -- therefor.

In column 8, line 12: insert -- into -- between "$\overline{RF}$" and "the", second occurrence.

In column 8, delete the formula in line 54 and substitute therefor the following:

-- $SS_{new} = SS_{old} \cdot \overline{RF}$, --

In column 10, delete line 39 and substitute therefor the following:

-- $SS_{new} = SS_{old} \cdot \overline{RF}$ (6)

(6) is obtained, as mentioned above. --

UNITED STATES PATENT AND TRADEMARK OFFICE

CERTIFICATE OF CORRECTION

PATENT NO. : 4,827,937

DATED : May 9, 1989

INVENTOR(S) : Rolf Kohler, Peter Schmidt and Manfred Schmitt

It is certified that error appears in the above-identified patent and that said Letters Patent is hereby corrected as shown below:

In columns 14 and 15, delete the table and substitute therefor the following:

| Disturbance | Mult. | Add. | Time Constant Slow/Fast | Controlled Correction |
|---|---|---|---|---|
| Air Temperature | X | | X--------X | Yes |
| Air Pressure | X | | X--------X | No |
| Fuel Pressure (dependent on controller) | X | | X | No |
| Fuel Pressure (dependent on $U_{Batt}$) | X | | X | Yes |
| Valve Opening | X | | X | No |
| Valve (operating/valve pull-in times) | | X | X | No |
| Potentiometer Adjustment | | X | X--------X | No |
| Flap Contamination (Multipoint) | | X | X | No |
| Temperature Difference (Flap/Intake Pipe) | | X | X | Partly |
| Tank Venting | | X | -X- | No |
| Crankcase Venting | | X | -X- | No |
| Fuel Quality | X | | ---X | No |

UNITED STATES PATENT AND TRADEMARK OFFICE

CERTIFICATE OF CORRECTION

PATENT NO. : 4,827,937

DATED : May 9, 1989

INVENTOR(S) : Rolf Kohler, Peter Schmidt and Manfred Schmitt

It is certified that error appears in the above-identified patent and that said Letters Patent is hereby corrected as shown below:

In column 15, line 24, delete "characteristics" and substitute -- characteristic -- therefor.

In column 15, line 26, delete "random-acess" and substitute -- random-access -- therefor.

In column 15, delete the formula in line 41 and substitute therefor the following:

$$F_{new} = F_{old}\ 1 + (\overline{RF}-1) \cdot a \cong F_{old} + (\overline{RF}-1) \cdot a$$

UNITED STATES PATENT AND TRADEMARK OFFICE

CERTIFICATE OF CORRECTION

PATENT NO. : 4,827,937

DATED : May 9, 1989

INVENTOR(S) : Rolf Kohler, Peter Schmidt and Manfred Schmitt

It is certified that error appears in the above-identified patent and that said Letters Patent is hereby corrected as shown below:

In column 15, delete the formula in line 43 and substitute therefor the following:

$$GF_{new} = GF_{old}\ 1 + (\overline{RF}-1) \cdot b \cong GF_{old} + (\overline{RF}-1) \cdot b$$

In column 15, line 56, delete "digram" and substitute -- diagram -- therefor.

In column 16, line 61, delete "resposive" and substitute -- responsive -- therefor.

In column 17, line 25, delete "factory" and substitute -- factor -- therefor.

UNITED STATES PATENT AND TRADEMARK OFFICE

CERTIFICATE OF CORRECTION

PATENT NO. : 4,827,937

DATED : May 9, 1989

INVENTOR(S) : Rolf Kohler, Peter Schmidt and Manfred Schmitt

It is certified that error appears in the above-identified patent and that said Letters Patent is hereby corrected as shown below:

In column 17, line 67, delete "fianlly" and substitute -- finally -- therefor.

In column 18, line 14, delete "contorl" and substitute -- control -- therefor.

In column 18, line 41, delete "said" and substitute -- aid -- therefor.

In column 18, line 42, delete "displacment" and substitute -- displacement -- therefor.

In column 19, line 1, delete "average" and substitute -- averaged -- therefor.

UNITED STATES PATENT AND TRADEMARK OFFICE

CERTIFICATE OF CORRECTION

PATENT NO. : 4,827,937

DATED : May 9, 1989

INVENTOR(S) : Rolf Kohler, Peter Schmidt and Manfred Schmitt

It is certified that error appears in the above-identified patent and that said Letters Patent is hereby corrected as shown below:

In column 19, line 9, delete "average" and substitute -- averaged -- therefor.

In column 19, line 17, delete "intervgal" and substitute -- interval -- therefor.

In column 19, line 31, delete "average" and substitute -- averaged -- therefor.

In column 19, line 36, delete "memroy II" and substitute -- memory II -- therefor.

In column 19, line 40, delete "memroy" and substitute -- memory -- therefor.

UNITED STATES PATENT AND TRADEMARK OFFICE

CERTIFICATE OF CORRECTION

PATENT NO. : 4,827,937

DATED : May 9, 1989

INVENTOR(S) : Rolf Kohler, Peter Schmidt and Manfred Schmitt

It is certified that error appears in the above-identified patent and that said Letters Patent is hereby corrected as shown below:

In column 19, line 42, delete "memory 11" and substitute -- memory II -- therefor.

In column 20, line 19, delete "average" and substitute -- averaged -- therefor.

In column 20, line 24, delete "values," and substitute -- values -- therefor.

Signed and Sealed this

Tenth Day of April, 1990

*Attest:*

HARRY F. MANBECK, JR.

*Attesting Officer*

*Commissioner of Patents and Trademarks*